United States Patent [19]

Veazey

[11] 4,118,190

[45] Oct. 3, 1978

[54] METHOD FOR ANNEALING ACRYLONITRILE-CONTAINING FILAMENTS

[75] Inventor: Thomas M. Veazey, Decatur, Ala.

[73] Assignee: Monsanto Company, St. Louis, Mo.

[21] Appl. No.: 821,264

[22] Filed: Aug. 3, 1977

[51] Int. Cl.[2] ..... D06B 5/06

[52] U.S. Cl. ..... 8/149.3; 8/151; 68/6; 68/181 R; 68/DIG. 1; 28/219

[58] Field of Search ..... 28/219, 283; 19/66 R, 19/65 T, 66 T; 8/149.3, 151; 68/5 D, 6, 181 R; 226/119; 34/155, 159, 160, 161

[56] References Cited

U.S. PATENT DOCUMENTS

| | | | |
|---|---|---|---|
| 1,509,359 | 9/1924 | Lawson | 19/66 R |
| 3,285,041 | 11/1966 | Valls | 68/6 X |
| 3,465,553 | 9/1969 | Muller et al. | 68/181 R X |

*Primary Examiner*—Dorsey Newton
*Attorney, Agent, or Firm*—Robert L. Broad, Jr.

[57] ABSTRACT

The method of annealing a tow of acrylonitrile-containing filaments, wherein the tow is advanced along a path through a housing under tension less than the shrinking tension of the tow, the path having at least two bends in opposite directions to each other, and passing steam along the walls of the housing to the inside corners of the bends, the steam having a sufficient velocity that it clings in layers to the walls of the housing to the inside corners thereof, the bends being sufficiently great that the steam will separate from the walls of the housing and pass through the tow at a tow-forwarding velocity at the inside corners.

7 Claims, 2 Drawing Figures

METHOD FOR ANNEALING ACRYLONITRILE-CONTAINING FILAMENTS

BACKGROUND OF THE INVENTION a. Field of the Invention

This invention relates to methods of annealing tows of acrylonitrile-containing filaments.

b. Prior Art

In the manufacture of acrylonitrile-containing filaments by certain processes, it is necessary to anneal or heat treat the filaments and simultaneously allow them to shrink in order to prevent subsequent filament fibrillation. The conventional method of annealing acrylonitrile-containing filaments is a batch process, where a tow of the filaments is placed in an autoclave and the autoclave filled with steam under pressure. Disadvantages of this method are that it is a batch process and that excessive handling of the filaments is required.

Attempts have been made to anneal acrylic filaments by continuous processes at steam pressures above atmospheric. In some of these attempts, tows were passed through a chamber containing steam under pressure and having seals at each end through which the tow is passed. These devices suffered from poor sealing and excessive wear of the seals. Also, tow tension was excessive.

Attempts have been made to anneal acrylic tow using steam at atmospheric pressure in a device having no end seals. In these devices, steam penetration of the tow has been poor and frequently the tension necessary to pull the tow through the device has prevented adequate tow shrinkage. Unless the tow is allowed to shrink while in the presence of steam, the filaments will tend to fibrillate under conditions of usage.

SUMMARY OF THE INVENTION

The method of annealing a tow of acrylonitrile-containing filaments, wherein the tow is advanced along a path through the housing under a tension less than the shrinking tension of the tow, the path having at least two bends in opposite directions to each other, and passing steam along the walls of the housing to the inside corners of the bends, the steam having a velocity such that it clings in layers to the walls of the housing and the bends of the inside corners being sufficiently great that the steam will separate from the walls at these bends and pass through the tow at a tow forwarding velocity.

DETAILED DESCRIPTION OF THE INVENTION

Figure 1:
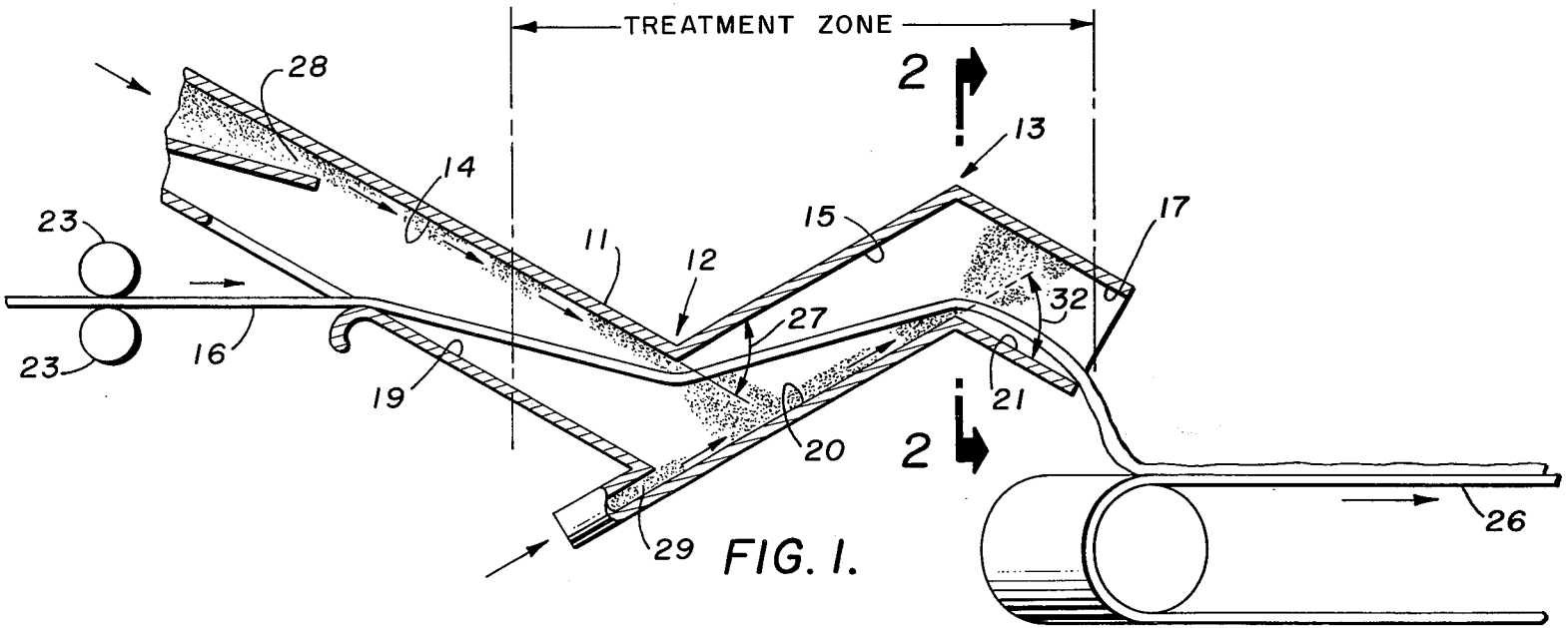
FIG. 1 is a schematic side view of apparatus useful in carrying out the process of the present invention, showing the sawtooth path of the tow through the apparatus.
Figure 2:
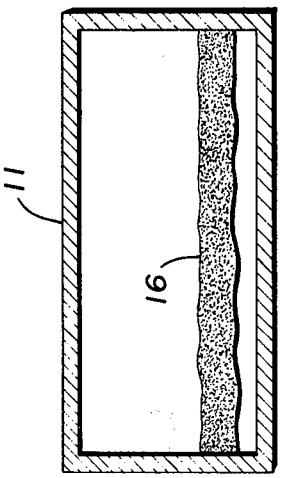
FIG. 2 is a cross-sectional view taken on line 2—2 of FIG. 1 showing the cross-sectional configuration of the tow passing through the apparatus.

FIGS. 1 and 2 schematically show apparatus suitable for carrying out the process of the present invention. This apparatus consists of a housing 11 having a rectangular cross-section as shown in FIG. 2 and at least two bends 12 and 13, the bend 12 being upward and the bend 13 being downward. The cross-sectional configuration of the housing 11 is such that a tow 16 in the form of a flat ribbon of filaments passes through the conduit 11 along a path having a sawtooth configuration when viewed from the side, as illustrated in FIG. 1. Preferably, the tow 16 is wet when it enters the housing 11. The tow may already be wet as a result of an earlier process step or water may be applied to the tow in a wetting step (not shown) in the process line ahead of the annealing process.

The upper limits of the tow path are defined by the downwardly-facing inner surface of the upper wall of the conduit 11. This downwardly-facing surface is made of a guide surface 14, a "downstream" surface 15 and an exit surface 17 connected in series in the order enumerated. The lower limits of the tow path are defined by the upwardly-facing inner surface of the lower wall of the bottom of the portion of the conduit 11, this wall being made up of an inlet surface 19, a guide surface 20 and a "downstream" surface 21.

The tow 16 is fed into the housing 11 by a pair of feed rolls 22 and is carried away from the housing by a moving belt 26. The belt 23 is sufficiently close to the exit end of the housing 11 that the weight of the tows extending from the housing to the belt is not sufficient to prevent shrinkage of the tow. While a moving belt is preferred for relieving the annealed tow, takeup rolls (not shown) can be used. If rolls are used, these rolls should be driven at a lower peripheral speed than the rolls 22 in order to allow the tow 16 to shrink under the influence of steam to be applied to the tow as described below.

If the tow is not allowed to shrink, the filaments making up the tow will tend to fibrillate under conditions of usage. Thus, the tension exerted on the tow 16 being treated must be less than the shrinkage tension of the tow, regardless of the manner in which the tow is carried away from the housing 11.

The housing 11 is provided with a first steam nozzle 28 having a configuration and being positioned such that this nozzle forces a stream of steam in a flat sheet down the guide surface 14. The velocity of this stream is sufficiently high that the Coanda effect will cause this steam to cling in a layer to the guide surface 14 until it reaches the inside corner of the bend 12. This layer of steam will "lubricate" the guide surface 14 for the passage of the tow 16. The downstream (in the sense that it is downstream of the guide surface 14) surface 15 intersects the surface 14 at an angle 27 which is sufficiently great that the layer of steam will separate from the inner wall of the upper wall of the housing 11 and impinge upon and pass through the tow 16. If the angle 27 is less than about 45° or if the inside corner of the bend 12 is rounded too much the Coanda effect will cause the layer of steam to flow around this corner and along the downstream surface 15, thereby defeating the purpose of the process. In addition to annealing the tow as it passes therethrough, the layer of steam lifts the tow out of contact with the inside corner of the bend 12 and moves the tow forward through the housing.

The housing is provided with a second steam inlet 29, positioned as shown in FIG. 1, to direct a layer of steam along the guide surface 20 to the inside corner of the bend 13. The velocity of the steam is sufficient that the Coanda effect will cause the steam to flow along the surface 20 in a thin layer to the inside corner of the bend 13. The guide surface 20 intersects the downstream surface 21 at an angle 32 which is sufficiently great that the layer of steam will separate from the wall of the housing 11 and pass through the tow at the bend 13 in the housing. The angle 32 should be at least about 45° and the inside corner of the bend 13 should be relatively sharp. Otherwise, the Coanda effect will cause the layer of steam flowing along the guide surface 20 to turn and flow along the downstream surface 21 instead of separating from the wall of the housing and passing through the tow 16.

The layer of steam traveling along the guide surface 20 lubricates this surface for the passage of the tow 16 and lifts the tow out of contact with the inside corner of the bend 13. In addition to annealing the wet tow as it passes therethrough, this layer of steam advances the tow through the housing 11. The extent of the tow treatment zone is indicated in FIG. 1.

The layers of steam flowing along the guide surfaces 14 and 20 not only pass through the tow 16 from opposite sides to anneal the filaments in the tow but also maintain the tow out of contact with the housing in the treatment zone and forward the tow through the housing. By maintaining a low tension on the tow in the treatment zone, the filaments in the tow will shrink sufficiently under the influence of the steam that these filaments will not subsequently fibrillate under conditions of usage.

What is claimed is:

1. The method of annealing a tow of acrylonitrile-containing filaments, comprising:

a. advancing the tow along a path through a housing under a tension less than the shrinking tension of the tow, said path having at least two bends, said bends having inside and outside corners and being in opposite directions to each other, and b. passing a heated annealing fluid along the walls of the housing leading to the inside corners of the bends, said fluid having a velocity such that said fluid clings in a layer to the walls of the housing to said inside corners, the angles of the bends of said inside corners being sufficiently great that said fluid separates from said walls and passes through the tow for moving the tow out of contact with said inside corners and forwarding the tow along the path.

2. The process of claim 1 wherein the tow is wet when passing through the housing.

3. The method of claim 1 wherein the inside corners are bent at angles of at least about 45° and the tow path has a sawtooth configuration.

4. The method of claim 3 wherein the fluid is steam.

5. The method of claim 4 wherein one of the bends in the path is upward and the other is downward.

6. The method of claim 5 wherein the width of the path is greater than the height of the path in such a manner that the tow passes through the housing in the form of a ribbon.

7. The method of claim 6 wherein the tow leaving the housing is laid onto a moving belt.

* * * * *